United States Patent [19]

Chamberlain

[11] Patent Number: 4,643,165

[45] Date of Patent: Feb. 17, 1987

[54] NONPOLLUTING, HIGH EFFICIENCY FIREBOX FOR WOOD BURNING STOVE

[76] Inventor: Joseph G. Chamberlain, 12350 SW. 124th, Tigard, Oreg. 97223

[21] Appl. No.: 833,905

[22] Filed: Feb. 26, 1986

[51] Int. Cl.[4] ..... F24C 1/14

[52] U.S. Cl. ..... 126/77; 126/290; 126/60; 126/112

[58] Field of Search ..... 126/60, 61, 77, 80, 126/75, 65, 66, 112, 70, 72, 290, 291, 292; 237/50, 52

[56] References Cited

U.S. PATENT DOCUMENTS

| | | | |
|---|---|---|---|
| 795,226 | 7/1905 | Jensen | 126/290 |
| 2,414,147 | 1/1947 | Fleer | 126/77 |
| 2,456,570 | 12/1948 | Stuckey et al. | 126/77 |
| 2,842,076 | 7/1958 | Martin | 126/290 |
| 4,117,824 | 10/1978 | McIntire et al. | 126/290 |
| 4,362,146 | 12/1982 | Schuller | 126/77 |
| 4,432,335 | 2/1984 | Kilham | 126/60 |
| 4,438,756 | 3/1984 | Chamberlain et al. | 126/131 |
| 4,520,791 | 6/1985 | Chamberlain | 126/131 |

FOREIGN PATENT DOCUMENTS

| | | | |
|---|---|---|---|
| 601591 | 8/1934 | Fed. Rep. of Germany | 126/77 |

*Primary Examiner*—James C. Yeung

*Attorney, Agent, or Firm*—Klarquist, Sparkman, Campbell, Leigh & Whinston

[57] ABSTRACT

A firebox for a wood stove provides primary, secondary, and tertiary supplies of combustion air to the firebox. The primary supply of air enters from the front of the firebox and establishes a combustion flow downwardly to the fire. Smoke containing particulates and gases then rises from the fire to a flue opening through the top of the firebox. The secondary supply of air is added to the flow of smoke as it rises to combust particulates and gases in the smoke. The tertiary supply of air is then added to the flow of smoke in surrounding relationship to the smoke flow as it passes through a restriction opening, further combusting the smoke. The primary, secondary, and tertiary supplies of air enter the firebox through primary, secondary, and tertiary inlet ports, the cross-sectional areas of the ports being in the ratio of 2 to 1 to 1 to regulate the flow of air inward. The secondary and tertiary air supplies are preheated before being added to the combustion flow.

5 Claims, 6 Drawing Figures

NONPOLLUTING, HIGH EFFICIENCY FIREBOX FOR WOOD BURNING STOVE

BACKGROUND OF THE INVENTION

1. Field of the Invention

This invention relates to a wood stove which burns wood efficiently to combust hydrocarbons and gas by-products substantially and completely. More particularly, the invention concerns a wood burning stove which produces low levels of particulate emissions without a catalytic converter.

2. General Discussion of the Background

Wood stoves have become an increasingly popular means for heating homes and other structures. This popularity has created environmental problems because the wood burned in the stoves is incompletely combusted. The result is that particulate emissions such as unburned hydrocarbons, carbon monoxide and other gases, are expelled as smoke through the flue of the wood stove into the environment. This type of pollution creates smog and presents serious environmental problems in those parts of the country where wood burning stoves are extensively used.

Many regulatory agencies have begun to address this problem by limiting the acceptable amounts of particulate emissions from wood stoves being sold. The Oregon Department of Environmental Quality, for example, has limited particulate emissions for conventional wood burning stoves to 15 grams per hour after June 30, 1986, and only 9 grams per hour after June 30, 1988.

The wood stove industry has reacted by introducing catalytic wood burning stoves which cause smoke to ignite and burn at much lower temperatures than usual within the wood stove. Incompletely combusted material in the smoke is thereby more completely consumed, and more heat is produced by the same fuel load. Examples of such catalytic systems are U.S. Pat. No. 4,438,756 and U.S. Pat. No. 4,520,791. Such catalytic systems, however, have several drawbacks. The catalytic combustor is expensive, and therefore increases the original cost of the stove. The catalytic combustor is also exhausted after several years of use and must be replaced at a substantial additional cost. These factors have limited public acceptance of catalytic combustors in spite of their greatly reduced levels of particulate emissions. There is accordingly a need for a noncatalytic wood burning stove having low levels of particulate emissions that satisfy environmental regulations.

The Bosca FS 500 wood stove manufactured by Brugger Industries Ltd. of Wellington, New Zealand, has attempted to meet this need. The FS 500 is a wood burning stove having primary, secondary, and tertiary air supplies that feed oxygen to the fire at different positions along a flow path within the firebox. The primary air supply is fed to the burning pile of wood where primary combustion takes place, and smoke (which contains uncombusted materials) is generated. As the smoke moves upwardly in the firebox, it passes an elongated secondary air inlet that feeds additional air to the smoke and promotes secondary combustion. A tertiary supply of air is introduced into the flow path of the smoke downstream of the secondary supply to further promote burning and reduce particulate emissions to about 13.8 grams per hour.

Another approach to the problem involves regulating the stove damper so that the damper always remains substantially open. The temperature at which a fire burns is inversely proportional to the amount of particulate emissions produced. A very hot fire completely burns wood and smoke, while a cooler fire produces smoke with insufficient heat to ignite the particulates and gases in the smoke. It is therefore possible to reduce particulate emissions by governing the damper on a wood stove such that the fire will burn only at a vigorous, high heat producing level. This approach has the obvious drawback of limiting the range of heat output of the stove and reducing its effectiveness in comfortably controlling the temperature of a dwelling.

Neither the Bosca FS 500 nor stoves with dampers governed as aforesaid can achieve less than about 13.5 grams per hour particulate emissions without a catalytic combustor. It is accordingly an object of this invention to provide such a noncatalytic stove that efficiently combusts solid fuel and smoke particulates to reduce pollutant emissions to less than about 13.5 grams per hour.

Another important object of this invention is to provide such a wood burning stove that reduces particulate emissions without relying on exhaustible materials such as catalytic combustors that must be periodically replaced at great expense.

Still another important object of this invention is to provide such a stove that can reduce particulate emissions while continuing to operate over a broad range of heat outputs with the damper at varying positions.

SUMMARY OF THE INVENTION

This invention overcomes the deficiencies presented in the prior art by providing an apparatus and a method for efficiently burning a supply of wood to provide a substantially pollution-free source of heat.

The apparatus of the present invention is a wood stove comprised of a firebox for containing a wood burning fire. The firebox has a front opening, a door adapted to close the front opening, a flue outlet through the top of the firebox which communicates with a flue, and a horizontal baffle below the flue. The baffle divides the firebox into a lower chamber where the wood burns and an upper chamber adjacent the flue outlet. A primary inlet port adjacent the front opening communicates with an inlet slot along an edge of the opening for introducing a primary supply of combustion air which flows from the front to the bottom rear of the firebox where the burning wood is located. The burning wood produces smoke that contains uncombusted particulates and gases that then rise upwardly toward the top of the firebox and out of the flue.

Before the smoke leaves the firebox, the particulate content of the smoke is reduced by introducing a secondary supply of combustion air to the smoke as it travels between the fire and horizontal baffle, thereby further igniting the smoke to achieve additional combustion. The remaining smoke then passes through an opening in the baffle, the opening being circumscribed by a tertiary air inlet slot through which a tertiary supply of combustion air is introduced into the flow path of the smoke. Introducing the tertiary air supply into the smoke flow from an encircling slot further promotes combustion of particulates and other pollutants, thereby greatly reducing their emission into the environment.

The proportional volumes of primary, secondary, and tertiary combustion air introduced into the firebox are controlled by carefully selecting the sizes of inlet ports which admit combustion air into the firebox. It has been found that the cross-sectional areas of the primary, secondary, and tertiary ports should be in a ratio of about 2:1:1 to achieve the greatest reduction in particulate emissions.

In a preferred embodiment of the invention, a proportional flow regulating damper is placed over the inlet ports for varying their cross-sectional areas while maintaining the proper ratio of areas and air flows. In the disclosed embodiment, the inlet ports are aligned in a row and covered with a sliding metal damper strip. The strip has a series of flow regulating openings substantially identical in size, shape, and relative position to the inlet ports. The strip can slide between a fully open position in which the flow regulating openings of the strips are in register with the ports, and a fully closed position in which the solid portion of the strip completely covers the ports. The strip can also be positioned intermediate the open and closed positions such that only a portion of each port is exposed. The proportional inlet areas of each port can thereby be preserved while adjusting the damper to supply varying volumes of air to the stove. Increasing the supply of air increases the rate of combustion within the stove while decreasing the air supply conversely diminishes the combustion rate.

Additional objects and advantages of the present invention will become more apparent from the following detailed description of a preferred embodiment thereof.

BRIEF DESCRIPTION OF THE DRAWINGS

The features of my invention which are believed to be novel are set forth with particularity in the appended claims. The invention itself, however, both as to its organization and method of operation, may best be understood by reference to the following description taken in connection with the accompanying drawings, in which:

DETAILED DESCRIPTION OF PREFERRED EMBODIMENT

General Description

Figure 1:
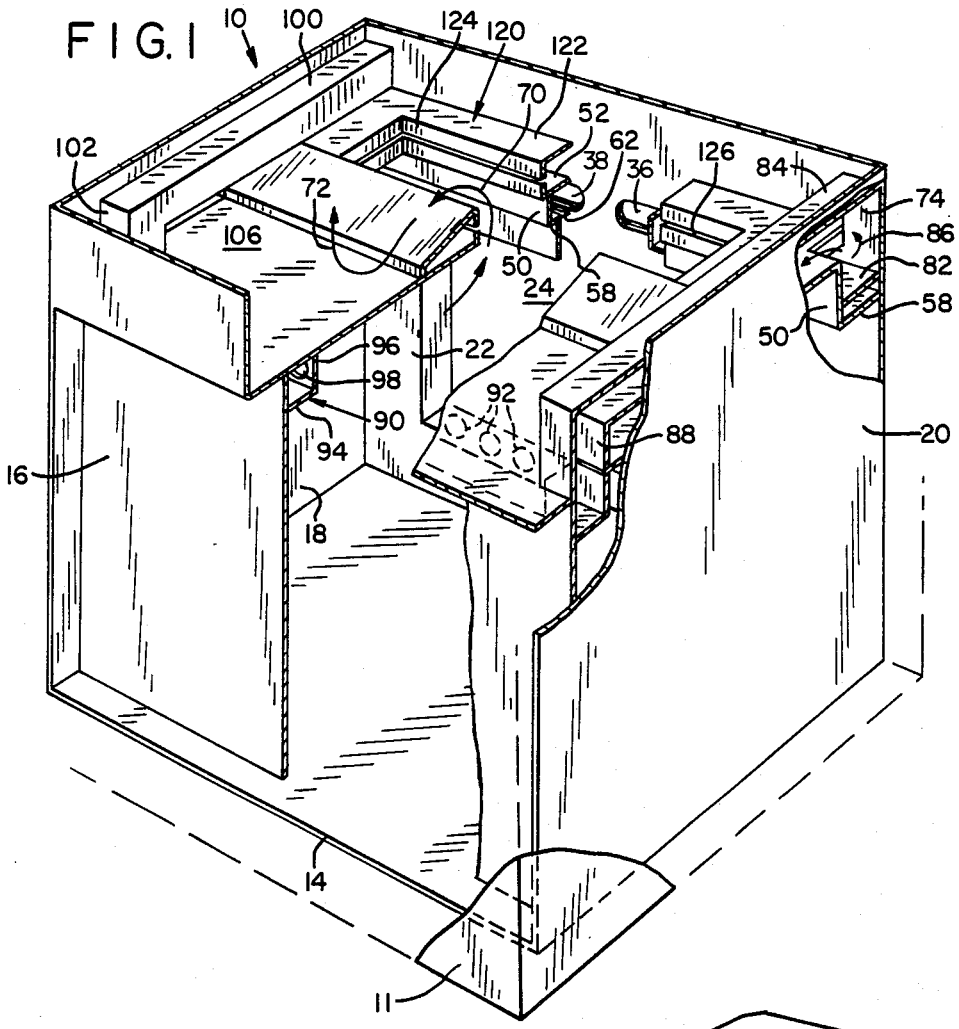
FIG. 1 is an upper, rear perspective view of a firebox, the top wall and outer rear wall having been removed and portions of the baffle, sidewalls, and inner rear walls being broken away to show internal portions of the firebox, the wood stove jacket being shown in phantom.

An illustrated embodiment of the invention is shown in the drawings to comprise a firebox 10 for incorporation into a wood stove 11. The firebox includes a top wall 12, bottom wall 14, inner rear wall 16, outer rear wall 17, sidewalls 18, 20, and front wall 22. Each of these walls is made of a heat exchanging material, such as cast-iron, and forms an enclosure adapted to contain a wood burning fire therein. Firebox 10 further includes a rectangular frontal access opening 24 having an outwardly extending continuous peripheral flange that includes upper edge 26 and lower edge 28. A hinged door 30 having a glass window (not shown) is adapted to close frontal access opening 24 to prevent uncontrolled loss of smoke and pollutants from the firebox during burning. A flue outlet 32 is provided through the rear portion of top wall 12 near its intersection with rear wall 16, and a cylindrical flue 33 surrounds outlet 32. A series of side by side, adjacent bricks 34 extend over half-way up walls 16, 18, and 20 to provide insulation and protection for the walls around the area where wood is placed and burned.

Particulate Emission Reduction Structure

Firebox 10 is provided with a means for reducing particulate emissions through flue outlet 32. Firebox 10 more completely combusts particulate matter than in previous wood stoves. Particulate matter is produced by the combustion of wood resting on bottom 14 of firebox 10, the particulates being carried with evolved gases, such as carbon monoxide, upwardly and out of flue outlet 32 and flue 33. The particulate reduction means includes a primary air inlet means to provide a primary combustion flow of air and allow initial combustion of wood on bottom 14, a secondary air inlet means to provide a flow of secondary combustion air in a secondary combustion zone adjacent rear wall 16, and a tertiary air inlet means to provide a tertiary flow of combustion air in encircling relationship to the flow of gases and particulates as they move towards the flue. The secondary and tertiary combustion zones enhance the degree of combustion of particulates and reduce their emission levels to satisfy environmental regulatory standards.

Combustion air enters firebox 10 through a plurality of ports in front wall 22 which are arranged in a row with the bottom edges of the ports being aligned. These ports include a pair of primary inlet ports 36, 38, a pair of secondary inlet ports 40, 42 and a pair of tertiary inlet ports 44, 46. The ports pass through front wall 22 above upper edge 26 of frontal access opening 24. The ports are horizontally elongated openings having rounded transverse edges. Primary ports 36, 38 are symmetrically arranged on either side of a midpoint 47 (FIGS. 2 and 3) of the row of ports, the cross-sectional areas and shapes of ports 36, 38 being the same. Secondary ports 40, 42 are also symmetrically arranged on either side of midpoint 47 adjacent sidewalls 20, 18, respectively, the cross-sectional areas and shapes of ports 40, 42 being the same. Tertiary ports 44, 46 are similarly symmetrically arranged on either side of midpoint 47, port 44 being between ports 36, 40 and port 46 being between ports 38, 42. The cross-sectional areas and shapes of ports 44, 46 are the same.

All of the ports are of substantially uniform horizontal width, and the horizontal distance between the rounded edges of adjacent ports is the same as the uniform width of each port. The height of each of ports 40, 42, 44, 46 is about one-half the height of each of ports 36, 38.

Behind the row of ports 36–46 is a chamber 48 which extends completely across front wall 22 and is defined by an upright rear partition 50, horizontal partition 52, upright side partitions 54, 56, bottom partition 58 and depending flange 60. Partition 52 and side partitions 54, 56 have an edge welded against front wall 22 of firebox 10. The width of bottom partition 58 is less than the width of partition 52 such that a continuous primary inlet slot 62 is defined between partition 58 and upper edge 26 across the front of firebox 10. Slot 62 therefore communicates with primary inlet ports 36, 38, such that the ports 36, 38, chamber 48 and slot 62 comprise a primary air inlet means.

The primary inlet means allows air to enter through ports 36, 38, spread out through chamber 48, move down through slot 62, and be evenly distributed across the length of frontal access opening 24. The air introduced through slot 62 then moves downwardly in firebox 10 along the path described by arrows 64 (FIG. 4) to provide a primary supply of combustion air to fire F in firebox 10 and establish a combustion flow of air to the fire. Once the combustion flow reaches the fire a combustion reaction occurs which produces hydrocarbon particulates and gases that then rise along the path designated by arrows 66, 68, 70, 71, and 72.

Secondary inlet ports 40, 42 respectively communicate with chambers 74, 76, each of which is defined by partitions 50, 52, 80, 82, front wall 22, and sidewall 18 or 20. Chamber 74 communicates with a square cross section conduit 84 as shown by arrow 86 (see FIG. 1), conduit 84 extending horizontally along the width of sidewall 20, then bending downwardly at portion 88 to communicate with an elongated, secondary air inlet chamber 90 extending across the rear of firebox 10. Chamber 90 is defined by rear wall 16, sidewalls 18, 20, horizontal partition 94, and vertical partition 96. A plurality of equally spaced, small diameter apertures 98 are provided through partition 96 of chamber 90. A second conduit 100, similar to conduit 84 and having a downward bend at 102 (FIG. 1), communicates between chamber 76 and secondary air inlet chamber 90 in a similar fashion. Air can therefore travel from secondary ports 40, 42 into chambers 74, 76, thence through conduits 84, 100 and down through bends 88, 102 into secondary inlet chamber 90 and through apertures 98. The combination of ports 40, 42, chambers 74, 76, conduits 84, 100, and secondary air inlet chamber 90 comprises a secondary air inlet means for providing a secondary supply of combustion air to the combustion flow at about arrow 68 (FIG. 4).

Figure 4:
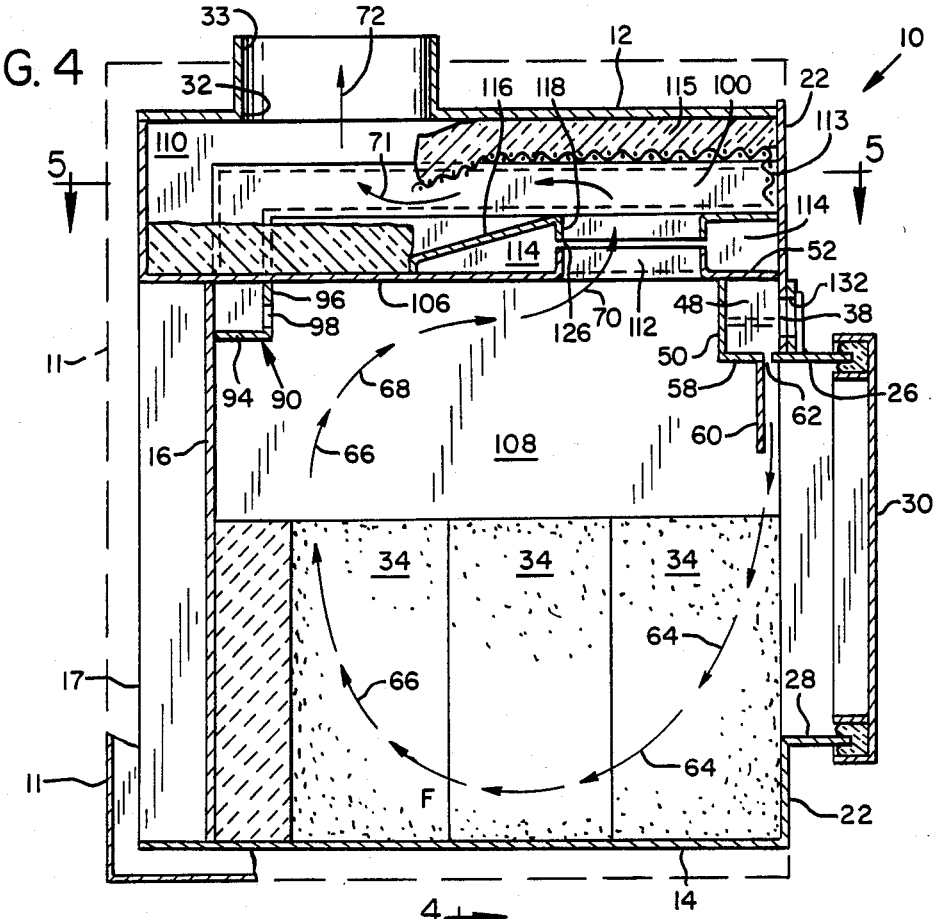
FIG. 4 is a vertical sectional view of the firebox taken along line 4—4 in FIG. 3, a door having been added to close the frontal opening, the wood stove jacket being shown in phantom.

A baffle 106 divides firebox 10 into a bottom chamber 108 and top chamber 110 (FIG. 4). Baffle 106 has a rectangular open area 112 extending across firebox 10 adjacent front wall 22 to the rear of partition 50. Open area 112 provides a passageway through which the combustion flow passes at 70. An L-shaped metal screen 113 (FIG. 4) is placed over opening 112 to hold a layer of fiber frax insulation 115 over the opening. Insulation 115 retains heat in the front portion of top chamber 110 of firebox 10 to better heat air passing through secondary air supply conduits 84, 100 and air passing through a tertiary air supply chamber 114. Preheating the secondary and tertiary air supplies helps combust hydrocarbon particulates and gases in the combustion flow.

A tertiary air inlet chamber 114 circumscribes passageway 112, the chamber 114 being defined along its rear edge by baffle 106, inclined top 116, and slotted front face 118. Chamber 114 is defined along its front and sides by a U-shaped channel 120 formed by partition 52, partition 122, and slotted inner face 124. Slotted faces 118, 124 cooperatively define a continuous tertiary air inlet slot 126 that circumscribes open area 112. Channel 120 communicates with chambers 128, 130 behind tertiary ports 44, 46, such that tertiary chamber 114 communicates with tertiary ports 44, 46.

The combination of tertiary ports 44, 46 communicating through chambers 128, 130 with tertiary chamber 114 and inlet slot 126 comprises a tertiary air inlet means which provides a tertiary supply of heated combustion air to the combustion flow at arrow 70. The tertiary supply of air is added to the combustion flow downstream of the location along which the secondary supply of air is added to the flow at arrow 68.

Adding separate primary, secondary, and tertiary supplies of combustion air at different points in the combustion flow provides a good combustion of particulates and other pollutants. In order to obtain an even greater reduction of pollutants, it is important that the respective air supplies be regulated to provide proportional supplies of combustion air. It has been found, for example, with the structure shown in the disclosed embodiment, that the cross-sectional area of inlet ports 36–46 should be proportioned so that the volume of air passing through the primary air inlet means is about twice the volume of air flowing into firebox 10 through the secondary or tertiary means. Specifically, it is preferred that the primary, secondary, and tertiary ports have cross-sectional areas in the ratio of about 2 to 1 to 1. It is believed that such proportions of the area of the ports provides primary, secondary, and tertiary air volumes to the fire in the ratio of 2 to 1 to 1.

Figure 2:
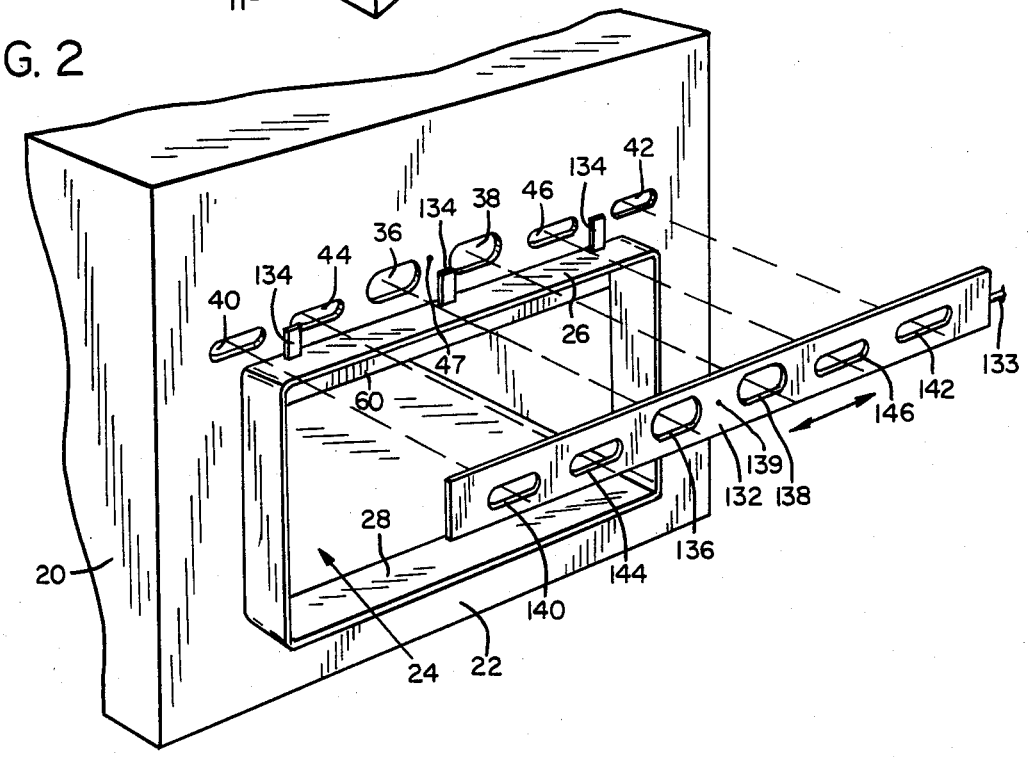
FIG. 2 is a fragmentary, front perspective, partially exploded view of the front wall of the firebox shown in FIG. 1, the positioning of a flow regulating strip on the front wall being illustrated with dotted lines.
Figure 3:
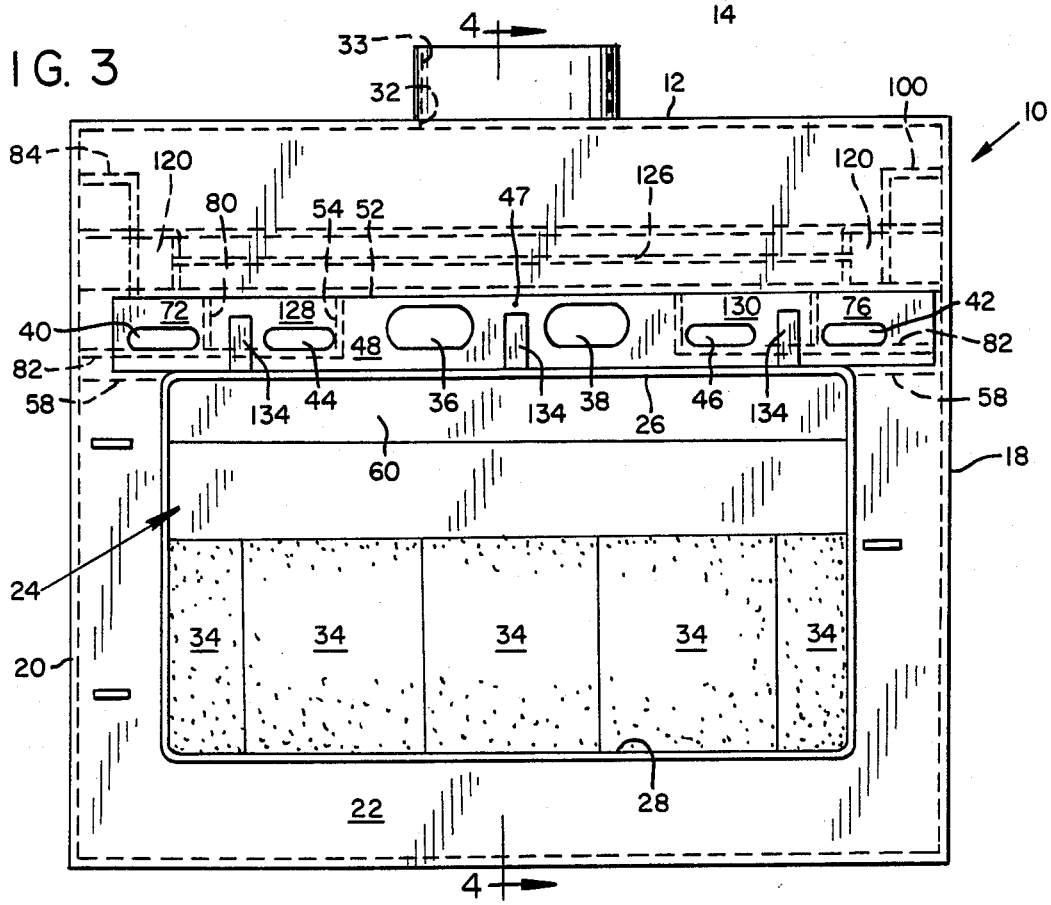
FIG. 3 is an enlarged, front elevational view of the firebox shown in FIG. 1, internal partitions, baffles, and conduits within the firebox being shown in phantom.
Figure 5:
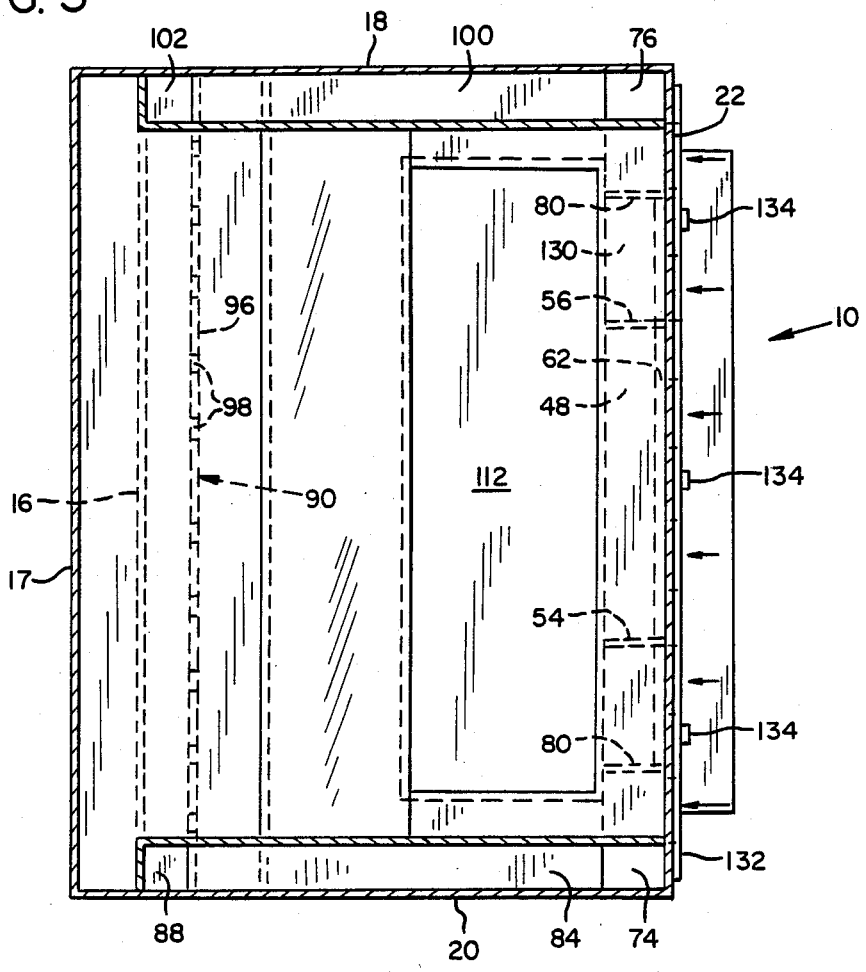
FIG. 5 is a top sectional view taken along line 5—5 of FIG. 4.

It is important that this 2 to 1 to 1 port area ratio be maintained during the operation of the wood stove. For this purpose, a proportional flow regulating means is provided that varies the cross-sectional area of ports 36–46 through which air enters while maintaining the preferred ratio of cross-sectional areas of the ports (see FIG. 6). The flow regulating means comprises a rectangular metal damper strip 132 which fits between front face 22 and retention tabs 134 such that strip 132 can freely slide relative to front face 22 when a horizontal force is exerted on strip 132 through arm 133 (FIG. 2). The strip has a pair of primary flow regulating openings 136, 138 symmetrically arranged on either side of the midpoint 139 of strip 132, a pair of secondary flow regulating openings 140, 142 symmetrically arranged on either side of the midpoint of strip 132 and adjacent the outer transverse ends, and a pair of tertiary flow regulating openings 144, 146 symmetrically arranged between each pair of primary and secondary flow regulating openings. Each of the primary openings 136, 138 is substantially identical in size, shape and relative position to each other as ports 36, 38 through front wall 22 of firebox 10. Each of the secondary flow regulating openings 140, 142 is substantially identical in size, shape, and relative position to each other as ports 40, 42. Finally, tertiary flow regulating openings 144, 146 are placed at an equal distance and relative position to the primary and secondary flow regulating openings 136–142 as ports 44, 46 are to the primary and secondary flow regulating ports 36–42.

Figure 6:
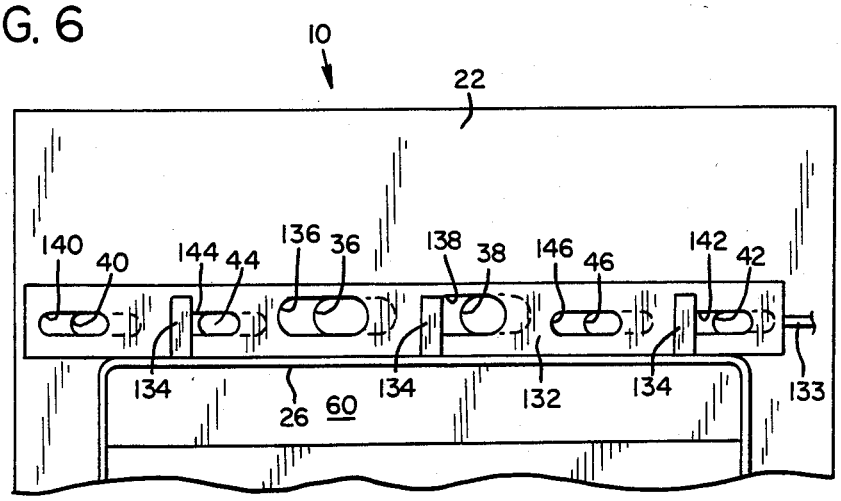
FIG. 6 is a fragmentary, front elevational view of the firebox showing the proportional flow regulating damper strip partially closing the inlet ports, the covered portions of the ports being shown in phantom.

As can best be seen by reference to FIG. 6, strip 132 is placed over ports 36–46 and can slide between a fully open position in which the flow regulating openings 136–146 are completely in register with ports 36–46, and a fully closed position in which the ports are completely covered by the solid portion of strip 132. The strip can also be placed at any intermediate position in which the flow regulating openings are only partially in register with the ports, as shown in FIG. 6. Strip 132 thereby functions as a damper control that changes the amount of air reaching the fire in firebox 10 and alters the rate of combustion of wood contained therein. The rate of combustion is directly proportional to the amount of air supplied through ports 36–46.

Burning Data

A test charge of Douglas fir having 16–20% moisture was loaded in firebox 10 at a loading density of 7 lbs wood/cubic foot. The wood was placed on bottom 14 toward rear wall 16, the wood ignited, and door 30 closed. The damper strip 132 was positioned relative to the inlet ports so that the pounds of air to pounds of fuel ratio was between 13 to 1 and 16 to 1. The details and results of several test runs are set forth in the following examples.

EXAMPLE I

The test charge was burned under the following conditions:

| | | |
|---|---|---|
| Burn Rate | 3.10 | (lb/hr-wet) |
| Burn Rate | 1.17 | (kg/hr-dry) |
| Burn Rate | 1.41 | (kg/hr-wet) |
| Wood Moisture (Wet Basis) | 16.53 | (%) |
| Heat Ouput | 15494.88 | (BTU/hr) |
| Fuel Higher Heating Value | 8750.00 | (BTU/hr-dry) |
| Average Stack Flow Rate | 7.72 | (SCFM) |
| Air to Fuel Ratio | 13.84 | (lb-air/lb-fuel) |
| Average Excess Air | 129.35 | (%) |
| Average Stack Temperature | 290.77 | (Deg. F.) |
| Average Stack Moisture (Wet Basis) | 9.00 | (%) |
| Average $CO_2$ | 7.84 | (%) |
| Average $O_2$ | 11.96 | (%) |
| Average CO | 0.90 | (%) |

The combustion efficiency of a wood stove is the percentage of heat actually generated in a firebox compared to the total potential energy in the fuel and indicates how completely fuel is burned. Heat transfer efficiency is the total heat transferred into an environment compared to the total heat generated by full combustion. Overall efficiency is a product of combustion and heat transfer efficiencies. The efficiency results for Example I were as follows:

| | |
|---|---|
| Combustion Efficiency | 89.7% |
| Heat Transfer Efficiency | 76.3% |
| Overall Efficiency | 68.4% |

Particulate emissions for this run were measured using a dilution sampler in accordance with EPA Method 5, or Oregon Department of Environmental Quality Method 41. Particulate emissions were found to be less than about 3 g/hour. Carbon monoxide emissions were 116.3 g/kg-wood.

EXAMPLE II

The test charge was burned under the following conditions:

| | | |
|---|---|---|
| Burn Rate | 4.21 | (lb/hr-wet) |
| Burn Rate | 1.58 | (kg/hr-dry) |
| Burn Rate | 1.91 | (kg/hr-wet) |

-continued

| | | |
|---|---|---|
| Wood Moisture (Wet Basis) | 17.36 | (%) |
| Heat Ouput | 19749.38 | (BTU/hr) |
| Fuel Higher Heating Value | 8750.00 | (BTU/hr-dry) |
| Average Stack Flow Rate | 11.00 | (SCFM) |
| Air to Fuel Ratio | 14.68 | (lb-air/lb-fuel) |
| Average Excess Air | 148.71 | (%) |
| Average Stack Temperature | 357.08 | (Deg. F.) |
| Average Stack Moisture (Wet Basis) | 9.45 | (%) |
| Average $CO_2$ | 7.57 | (%) |
| Average $O_2$ | 12.20 | (%) |
| Average CO | 0.81 | (%) |

The average efficiencies were as follows:

| | |
|---|---|
| Combustion Efficiency | 91.5% |
| Heat Transfer Efficiency | 71.0% |
| Overall Efficiency | 64.9% |

Particulate emissions for this run were measured as in Example I and again found to be 2.5–3.0 g/hr. Carbon monoxide emissions were 111.6 g/kg-wood.

EXAMPLE III

The test charge was burned under the following conditions:

| | | |
|---|---|---|
| Burn Rate | 7.36 | (lb/hr-wet) |
| Burn Rate | 2.78 | (kg/hr-dry) |
| Burn Rate | 3.34 | (kg/hr-wet) |
| Wood Moisture (Wet Basis) | 16.67 | (%) |
| Heat Ouput | 33946.27 | (BTU/hr) |
| Fuel Higher Heating Value | 8750.00 | (BTU/hr-dry) |
| Average Stack Flow Rate | 20.36 | (SCFM) |
| Air to Fuel Ratio | 15.40 | (lb-air/lb-fuel) |
| Average Excess Air | 200.62 | (%) |
| Average Stack Temperature | 466.67 | (Deg. F.) |
| Average Stack Moisture (Wet Basis) | 8.50 | (%) |
| Average $CO_2$ | 7.64 | (%) |
| Average $O_2$ | 12.41 | (%) |
| Average CO | 0.36 | (%) |

The average efficiencies were as follows:

| | |
|---|---|
| Combustion Efficiency | 94.7% |
| Heat Transfer Efficiency | 66.8% |
| Overall Efficiency | 63.3% |

Particulate emissions for this run were measured as in Example I and found to be 2.5–3.0 g/hr. Carbon monoxide emissions were 52.5 g/kg-wood.

EXAMPLE IV

The test charge was burned under the following conditions:

| | | |
|---|---|---|
| Burn Rate | 2.88 | (lb/hr-wet) |
| Burn Rate | 1.08 | (kg/hr-dry) |
| Burn Rate | 1.31 | (kg/hr-wet) |
| Wood Moisture (Wet Basis) | 17.36 | (%) |
| Heat Ouput | 14402.72 | (BTU/hr) |
| Fuel Higher Heating Value | 8750.00 | (BTU/hr-dry) |
| Average Stack Flow Rate | 7.47 | (SCFM) |
| Air to Fuel Ratio | 14.56 | (lb-air/lb-fuel) |
| Average Excess Air | 136.10 | (%) |
| Average Stack Temperature | 251.12 | (Deg. F.) |
| Average Stack Moisture (Wet Basis) | 9.70 | (%) |
| Average $CO_2$ | 7.42 | (%) |
| Average $O_2$ | 12.13 | (%) |
| Average CO | 1.08 | (%) |

The average efficiencies were as follows:

| | |
|---|---|
| Combustion Efficiency | 90.3% |
| Heat Transfer Efficiency | 76.6% |
| Overall Efficiency | 69.2% |

Particulate emissions for this test run were measured and found to be 2.5–3.0 g/hr. Carbon monoxide emissions were 147.8 g/kg-wood.

Method of Operation

Firebox 10 is incorporated into a wood stove structure 11 and used to warm an environment, such as the interior of a dwelling. Heat is generated by placing wood within firebox 10, igniting it, and closing door 30. Damper strip 132 is adjusted to regulate the flow of air through inlet ports 36–46 such that the pounds of air to pounds of fuel ratio is preferably 13:1 to 16:1. The proportional sizes of ports 36–46 supply this air through the primary, secondary, and tertiary air inlets in proportioned volumes of about 2:1:1.

The primary supply of combustion air is provided to the burning wood through slot 62. This combustion air moves down over the glass window of door 30 in the direction of arrows 64 and establishes a flow path of air which feeds the fire F and continues upwardly as a combustion flow of smoke containing hydrocarbon particulates and gases. The burning temperature of fire F is about 600° F., which is an insufficient temperature to combust the smoke rising in the direction of arrows 66.

As the smoke rises, it begins to cool and becomes even more difficult to combust. By the time the combustion flow reaches the position of arrow 68, however, heated air is introduced through apertures 98 of secondary air inlet chamber 90. The air has been heated during its movement through conduits 84, 100 which pass above the fire. Heated gases also accumulate in upper chamber 110 above baffle 106 to further heat the conduits and air passing through them. Introduction of the heated secondary supply of combustion air to the combustion flow at 68 ignites the smoke which now burns at a temperature of about 1000° F. Hydrocarbon particulates and gas content are reduced by being combusted at this very hot temperature.

The remaining smoke then moves with the combustion flow through open area 112 of baffle 106 as shown at arrow 70. The tertiary flow of combustion air is added to the combustion flow through slot 126 and in surrounding relationship to the flow path 70. Introducing the tertiary air from 360° into the flow creates a carburetor effect that produces another very hot burn of 1000°–1200° F., thereby consuming more particulates and gases in the smoke. Combustion is aided by the tertiary air having been preheated during its passage through chamber 114 above fire F.

The method and apparatus of the present invention can reduce particulate emissions from wood stoves to less than about 13 g/hr. By properly adjusting the proportional cross-sectional areas of inlet ports 36–46, a highly efficient combustion can be obtained that reduces particulate emissions below 9 g/hr to a range of about 2.5 to 9 g/hr. In the preferred embodiment described above, particulate emissions were about 3 g/hr.

The total air flow to fuel ratio should preferably be maintained between about 13:1 to 16:1 to achieve the most complete combustion of smoke pollutants. Such an air flow ratio will produce a fire that burns hot enough to substantially completely combust the smoke.

Having illustrated and described the principles of the invention in a preferred embodiment, it should be apparent to those skilled in the art that the invention can be modified in arrangement and detail without departing from such principles. I claim all modifications coming within the spirit and scope of the following claims.

I claim:

1. A wood stove comprising:

a firebox having top, bottom, rear, and side heat-exchanging walls, and adapted to contain a wood burning fire therein;

the firebox including a frontal access opening, a door adapted to close the frontal access opening, and a flue outlet through the top wall;

a primary air inlet means comprising a primary inlet port through the front wall adjacent the frontal access opening, and a primary inlet slot adjacent the frontal access opening and in communication with the primary inlet port to provide a primary supply of combustion air to the fire in the firebox and establish a combustion flow to the fire and thence to the flue outlet;

a secondary air inlet means comprising a secondary inlet port through the front wall adjacent the frontal access opening, an elongated secondary air inlet member extending across the rear of the firebox above the fire and a conduit communicating between said port and said air inlet member, the conduit being in heat receiving relationship to the fire to provide a secondary supply of heated combustion air to the combustion flow between the fire and flue outlet;

a baffle dividing the firebox into a bottom chamber and a top chamber, the baffle having an open area adjacent the front wall through which the combustion flow passes; and a tertiary air inlet means comprising a tertiary inlet port through the front wall adjacent the frontal access opening, and a tertiary inlet slot around the open area in the partition, the tertiary inlet port communicating with the tertiary inlet slot to provide a tertiary supply of heated combustion air in surrounding relationship to the combustion flow downstream of the secondary air inlet.

2. The wood stove of claim 1 wherein the primary, secondary and tertiary ports have cross-sectional areas in the ratio of about 2:1:1.

3. The wood stove of claim 2, further comprising proportional flow regulating means for varying the port areas through which air enters while maintaining the ratio of cross-sectional areas of the ports.

4. The wood stove of claim 3 wherein the flow regulating means comprises a strip held in sliding relationship over the ports, the strip comprising a solid portion and a plurality of flow regulating openings substantially identical in size, shape, and relative position to the ports on the front wall, the strip sliding between an open position in which the flow regulating openings are in register with the ports and a close position in which the solid portion completely covers the ports.

5. A wood stove comprising:

a firebox having top, bottom, rear, and side heat exchanging cast-iron walls, and adapted to contain a wood burning fire therein;

the firebox including a rectilinear frontal access opening having upper and lower edges, a door adapted to close the frontal access opening, and a flue outlet through the top wall adjacent the rear wall;

a brick lining on the side walls in the interior of the firebox;

a primary air inlet means comprising a plurality of primary inlet ports through the front wall adjacent one of the edges of the frontal access opening, and a primary inlet slot in communication with the primary inlet port, the primary inlet slot extending adjacent one of the edges of the frontal access opening to provide a primary supply of combustion air to the fire in the firebox and establish a combustion flow to the fire and thence upward to the flue outlet;

a baffle dividing the firebox into a bottom chamber and a top chamber, the baffle having a rectilinear open area adjacent the front wall through which the combustion flow passes;

a secondary air inlet means comprising a pair of secondary inlet ports through the front wall adjacent one of the edges of the frontal access opening on either side of the primary inlet ports, an elongated secondary air inlet member extending across the rear of the firebox in the bottom chamber adjacent the rear wall and having a plurality of inlet holes therethrough, and an air inlet conduit communicating between each secondary air inlet port and the air inlet member, the inlet conduits passing through the top chamber of the firebox along opposing sidewalls above the baffle such that air is heated as it moves through the conduits to the secondary air inlet member;

a tertiary air inlet means comprising a pair of tertiary inlet ports through the front wall adjacent one of the edges of the frontal access opening, each tertiary inlet port being positioned between a primary and secondary inlet port, and a tertiary air inlet chamber comprising an air passageway around the periphery of the open area in the baffle, and a tertiary inlet slot in the chamber around the open area in the partition, the tertiary air inlet port communicating with the tertiary air inlet chamber to provide a tertiary supply of heated combustion air to the combustion flow downstream of the secondary air inlet means;

the primary, secondary, and tertiary ports being arranged in a row across the front wall and having cross-sectional areas in the ratio of about 2:1:1; and proportional flow regulating means for varying the port area through which air enters while maintaining the ratio of cross-sectional areas of the ports, the flow regulating means comprising a strip held in sliding relationship over the ports, the strip comprising a solid portion and a plurality of flow regulating openings substantially identical in size, shape, and relative position to the ports on the front wall, the strip sliding between an open position in which the flow regulating openings are in register with the ports and a closed position in which the solid portion completely covers the ports.

* * * * *